US005917114A

United States Patent [19]

Rapp

[11] Patent Number: 5,917,114

[45] Date of Patent: Jun. 29, 1999

[54] DEGASSING OF LIQUID ALUMINUM AND OTHER METALS

[75] Inventor: Robert A. Rapp, Columbus, Ohio

[73] Assignee: The Ohio State University, Columbus, Ohio

[21] Appl. No.: 08/961,977

[22] Filed: Oct. 31, 1997

Related U.S. Application Data

[60] Provisional application No. 60/030,010, Nov. 1, 1996, and provisional application No. 60/032,457, Dec. 9, 1996.

[51] Int. Cl.[6] ..... C22B 9/05

[52] U.S. Cl. ..... 75/379; 75/558; 75/648; 75/680; 75/681

[58] Field of Search ..... 75/379, 558, 648, 75/680, 681

[56] References Cited

U.S. PATENT DOCUMENTS

| | | | |
|---|---|---|---|
| 3,961,778 | 6/1976 | Carbonnel et al. | 75/680 |
| 4,003,560 | 1/1977 | Carbonnel . | |
| 4,235,627 | 11/1980 | Dantzig et al. . | |
| 4,338,124 | 7/1982 | Bornard . | |
| 4,360,505 | 11/1982 | Sheridan, III et al. . | |
| 4,427,443 | 1/1984 | Merrien et al. . | |
| 4,714,494 | 12/1987 | Eckert . | |
| 4,816,237 | 3/1989 | Tomomura et al. . | |
| 4,959,202 | 9/1990 | Minet et al. . | |
| 5,024,696 | 6/1991 | Ryan . | |
| 5,145,514 | 9/1992 | Garipy et al. . | |
| 5,348,592 | 9/1994 | Garg et al. | 148/218 |
| 5,462,580 | 10/1995 | Eckert . | |
| 5,639,436 | 6/1997 | Benson et al. . | |

*Primary Examiner*—Melvyn Andrews
*Attorney, Agent, or Firm*—Kremblas, Foster Millard & Pollick

[57] ABSTRACT

Offgas recycling processes, including an argon degassing embodiment which cyclically regenerates one treatment flow path while the other treatment flow path is treating the offgas. The system is changed into a second mode to regenerate the previously treating portion of the system while the offgas is being treated by the previously regenerated treatment device. A second embodiment oxidizes a copper chloride bed to release chlorine, which is injected into the melt. The offgas contains chlorine and HCl, which react with a second bed, containing oxides of copper, forming copper chloride. Water vapor and nitrogen are exhausted to the environment. Before the beds are fully reacted, the flow of gas through the beds is reversed, oxidizing the CuCl bed and reducing the copper oxides.

11 Claims, 8 Drawing Sheets

Thermodynamic phase stability in the Cu-$O_2$-$Cl_2$ system at 300°C

Solubility of Hydrogen ($P_{H_2}$ = 1 atm) in Aluminum

Fig. 7

$2Cu + 1/2O_2 = Cu_2O$ $\Delta G^\circ$ (kJ) = $-170.07 + 7.498 \times 10^{-2} \times T$ (K)
$\log P_{O_2} = 2\,\Delta G^\circ / (2.303RT) = 7.832 - 17765 / T$ (K)

$Cu_2 + 1/2O_2 = 2CuO$ $\Delta G^\circ$ (kJ) = $-138.72 + 0.1026 \times T$ (K)
$\log P_{O_2} = 2\,\Delta G^\circ / (2.303RT) = 10.717 - 17765 / T$ (K)

$H_2 + 1/2O_2 = H_2O$ $\Delta G^\circ$ (kJ) = $-244.19 + 5.082 \times 10^{-2} \times T$ (K)
$\log (P_{H_2O}/P_{H_2}) = -\Delta G^\circ / (2.303RT) + 1/2 \log P_{O_2}$
$= -2.654 + 12753 / T$ (K) $+ 1/2 \log P_{O_2}$ $Cu/Cu_2O$

| T (°C) | $\Delta G^\circ$ (kJ) | $\log P_{O_2}$ | $\log (P_{H_2O}/P_{H_2})$ |
|---|---|---|---|
| 100 | -142.10 | -39.794 | 11.640 |
| 200 | -134.60 | -29.725 | 9.446 |
| 300 | -127.11 | -23.170 | 8.018 |
| 400 | -119.61 | -18.564 | 7.014 |
| 500 | -112.11 | -15.149 | 6.270 |

$Cu_2O/CuO$

| $\Delta G^\circ$ (kJ) | $\log P_{O_2}$ | $\log (P_{H_2O}/P_{H_2})$ |
|---|---|---|
| -100.460 | -28.133 | 17.471 |
| -90.204 | -19.920 | 14.348 |
| -79.947 | -14.574 | 12.316 |
| -69.690 | -10.816 | 10.888 |
| -59.433 | -8.031 | 9.829 |

Fig. 8

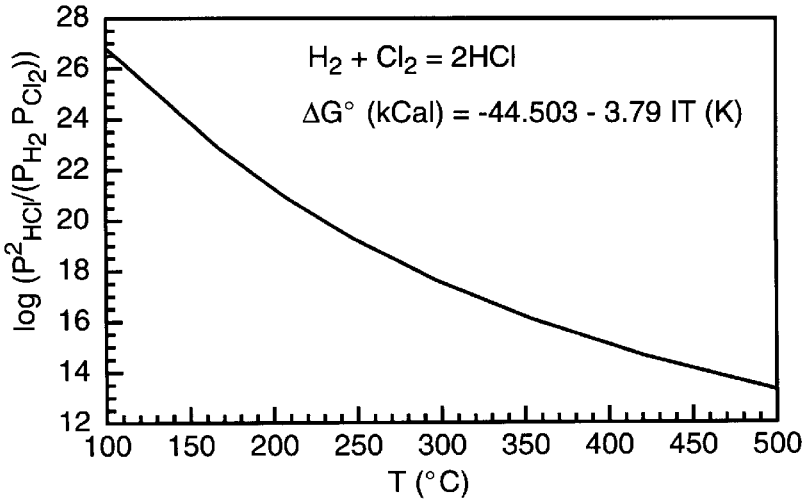

Equilibrium constant for $H_2$-$Cl_2$-HCl gas

Traces of Hydrogen and Oxygen Activity in Exit Gas (Run #1)

4.95% H2 in Ar at 3.49 cm/s linear velocity in be column heated at 225C calculated breakthrough time (c.b.t.) = 12.9h.

Traces of Oxygen Activity in Exit Gas (Run #1)

Air heated to 225°C at 2.00 cm/s linear velocity in bed
Calculated breakthrough time (c.b.t.) = 2.65 h.

DEGASSING OF LIQUID ALUMINUM AND OTHER METALS

CROSS-REFERENCES TO RELATED APPLICATIONS

This application claims the benefits of U.S. Provisional application Ser. No. 60/030,010 filed Nov. 1, 1996 and U.S. Provisional application Ser. No. 60/032,457 filed Dec. 9, 1996.

BACKGROUND OF THE INVENTION

1. Field of the Invention

The invention relates to methods for removing gases from liquid metal, and more specifically to two preferred embodiments relating to methods for removing dissolved hydrogen gas from liquid aluminum.

2. Description of the Related Art

During manufacture of aluminum, it is necessary to remove hydrogen when the aluminum is in a liquid state in order to minimize the porosity of the resulting cast product. By one conventional method, an inert carrier gas is directed through the melt to mix with and remove dissolved hydrogen gas. Conventional devices use an argon carrier gas which is injected into the melt, causing hydrogen to enter the gas bubble and escape with the argon. This gas is then exhausted into the environment. Substantial cost is involved with removing hydrogen due to the significant volume of argon required to remove a relatively small volume of hydrogen, and the product gas is exhausted into the environment. It would be desirable to retain and recycle the inert gas which is otherwise lost.

In another conventional process, an inert carrier gas such as argon or nitrogen is injected into the melt with a small amount of chlorine gas. Chlorine reacts with undesirable contents of dissolved alkaline and alkaline earth metals, such as sodium and calcium, to form salts which are fluxed out of the melt. Some of the chlorine reacts with hydrogen dissolved in the melt to form HCl, since HCl is stable. However, some excess chlorine also escapes to the environment. Chlorine gas is costly and difficult to handle, and it is undesirable to release chlorine and HCl into the ambient. This is due to its deleterious effect to the environment, and its corrosive effects upon the surrounding equipment and structures. It would be desirable to capture and retain the chlorine within a closed system and to recycle this part of the chlorine which is used in melt treatment systems.

SUMMARY OF THE INVENTION

The invention is improved offgas stream recycling processes, used in degassing and fluxing of an aluminum melt, or other molten metals.

In the preferred embodiment of the invention, an inert carrier gas (e.g. argon) is directed into the aluminum melt to form an offgas stream from the melt containing hydrogen. This process comprises directing the offgas stream through a first bed containing supported catalytic copper oxide particles, forming water vapor and transforming the copper oxide into substantially copper. The argon gas stream containing water vapor is then directed through a first desiccant chamber for absorbing the water vapor, and the dried argon passing out of the desiccant is then preferably pumped back into the aluminum melt. After the first copper oxide bed is converted mostly to copper, the offgas stream is diverted through a second bed containing substantially copper oxide, to form water vapor and transforming the copper oxide into substantially copper. The gas stream from the second bed is then directed through a second desiccant chamber for absorbing the water vapor. The gas stream leaving the second desiccant, substantially comprising the inert carrier gas, is pumped back into the aluminum melt. At the same time, a separate stream of air or nitrogen-enriched oxygen is simultaneously passed through the first bed to oxidize and regenerate the first bed. The oxidation by air converts the copper in the first bed into substantially copper oxide, and the hot nitrogen product gas evaporates a substantial portion of the water absorbed in the first desiccant as an exhaust stream into the environment. After the second copper oxide bed is converted mostly to copper, the flow of gas reverts to the initial setting.

In an alternative embodiment, chlorine gas carried in an inert gas (e.g. nitrogen) is directed into the melt to form an offgas stream containing hydrogen, hydrogen chloride, and chlorine. The process comprises a first step of directing air through a first bed made of supported catalytic metal chloride particles. The metal chloride is oxidized by the air, replacing the oxygen in the air with chlorine gas, and the metal chloride in the first bed is transformed into metal oxide particles. The chlorine and nitrogen gas mixture is directed into the melt. The offgas stream from the melt is directed through a second bed made initially of supported catalytic metal oxide particles. The offgas stream transforms the metal oxide particles in the second bed into substantially metal chloride particles and forms water vapor. The process further comprises directing the gas stream of nitrogen and water vapor from the second bed into the environment.

Before either of the two beds are fully reacted, the flow of gas through the beds is reversed, in response to an in-line (or in-stream) sensor, and air is directed through the second bed, forming a nitrogen and chlorine gas mixture as the metal chloride in the second bed is oxidized. The chlorine and nitrogen gas mixture is injected into the melt, forming an offgas containing some hydrogen chloride and chlorine. The offgas stream from the melt is diverted through the first bed made substantially of metal oxide, wherein the offgas stream reacts to form water vapor and nitrogen gas, and transforms the metal oxide into substantially metal chloride. The gas mixture of nitrogen and water vapor is then exhausted into the environment.

BRIEF DESCRIPTION OF THE DRAWINGS

FIG. 7 is a table showing chemical reactions;

FIG. 8 is a graph showing the thermodynamic stability of HCl as a function of temperature.

Figure 1:
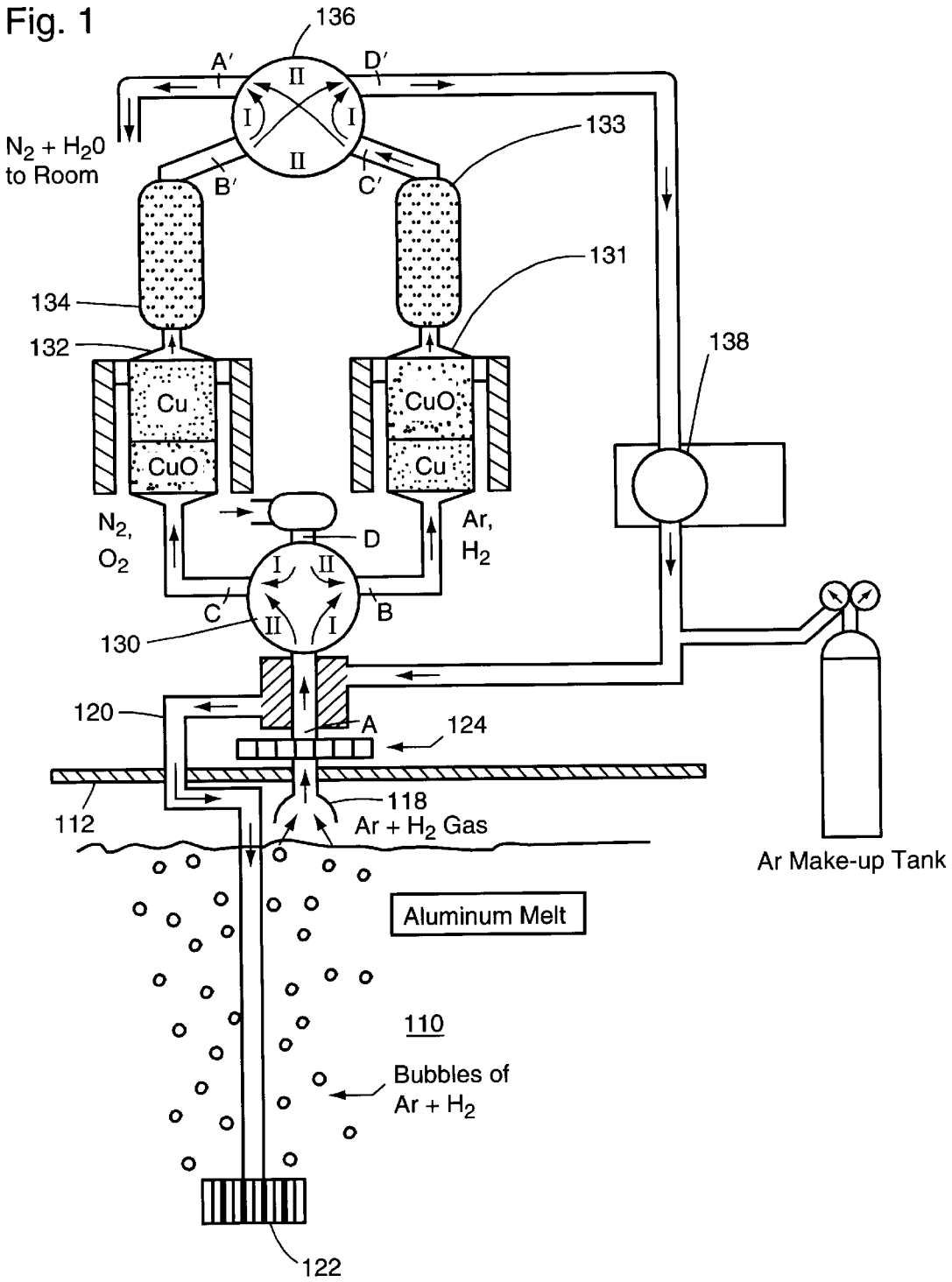
FIG. 1 is a schematic front view illustrating one embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

BRIEF DESCRIPTION OF THE PREFERRED EMBODIMENT

The preferred embodiment of the present invention is shown in FIG. 1. This process is shown, for example, being used to degas an aluminum melt by argon purging, but this process can be used to degas virtually any liquid metal (such as, for example, copper or steel) , and any other inert gas (such as, for example, nitrogen or helium) can be used. The carrier gas is preferably argon.

An aluminum melt 110 is treated by directing argon gas through an inlet tube 120 and a gas disperser 122. The submerged parts of the disperser 122 and tube 120 should be made of material resistant to aluminum melts, such as borided titanium. The treatment tank has a gas outlet 118 through which gas released from the melt is conveyed to the offgas treatment system.

The carrier gas injected into the melt removes dissolved hydrogen and forms bubbles in a conventional manner. The degassing process can be operated as either a batch or a continuous process.

The offgas stream released in the embodiment of FIG. 1 is a combination of the carrier gas plus hydrogen gas ($H_2$). The offgas stream passes upwardly through the conduit A into a first valve 130, which in a first mode directs the offgas stream to the conduit B. The offgas stream passes into a first bed 131 comprising primarily oxides of copper (CuO and $Cu_2O$). The copper oxides were chosen because of their low thermodynamic stability and rapid reaction kinetics at temperatures as low as 50° C. The offgas reacts with the oxides according to the reactions $$H_2(g)+CuO=H_2O(g)+Cu \qquad \text{REACTION 1}$$

and $$H_2(g)+Cu_2O=H_2O(g)+2Cu \qquad \text{REACTION 2}$$

forming copper in the bed and water vapor which passes into an easily regenerated desiccant 133. The water vapor is absorbed by the desiccant, and the carrier gas (such as Ar) passes from the conduit C' through a second valve 136 into the conduit D'. The carrier gas is conveyed by a compressor pump 138 back into the melt to remove more dissolved hydrogen. By recycling the carrier gas in this manner, very little of the carrier gas is lost, which reduces the costs of treatment.

Once the first bed 131 approaches a condition of total reaction with hydrogen from the offgas (i.e. once most of the copper oxide in the bed is converted to mostly copper), the valves 130 and 136 are actuated in response to an in-line sensor to the second mode of operation. The need to actuate the valves 130 and 136 can be determined by a sensor measuring the electrical resistance or the temperature near the exit of the bed 131. The electrical resistance can be measured because during the process, the copper oxides in the bed will be reduced by hydrogen to form copper. A rise in temperature can also indicate the location of the reaction front, since the reactions are exothermic. Since the copper will be formed progressively from the bottom of the bed toward the top, a sensor conveniently located near or at the top of the bed can be used to sense an electrical resistance or temperature change. Well-known, conventional sensors may be used to actuate the beds from one mode to the other. Such a sensor measures the electrical resistance (or temperature) and signals actuators to change the valves 130 and 136 into the second mode when the electrical resistance (or temperature) reaches a predetermined level. In this second mode, offgas in the conduit A is directed to the conduit C and into the second bed 132 instead of the first bed 131. The second bed 132 is made substantially of supported catalytic oxides of copper which react in the same manner as the bed 131 did initially to transform the hydrogen gas into water vapor upon the reduction of copper oxide. The second desiccant 134 absorbs the water vapor, and the carrier gas passes out of the second desiccant 134 into the conduit B'. The valve 136 directs the gas in the conduit B' into the conduit D' and then into the treatment tank 112.

At the same time the second bed 132 is transforming the hydrogen gas into water vapor, an oxygen-containing gas, preferably air or nitrogen-enriched air, is blown into the conduit D and directed by the valve 130 into the conduit B. The air passes through the first bed 131, oxidizing the copper to form CuO and $Cu_2O$. This air may be heated to approximately 200° C. in the bed 131 either by the exothermic reactions or some external means. The heated air passes out of the bed 131 through the first desiccant 133, absorbing a significant amount of water from the desiccant 133. The combination of water vapor and reacted air (most of which is nitrogen since the $O_2$ oxidizes the copper) passes from the conduit C' through the valve 136 and into the conduit A' where it is exhausted to the environment.

Once the copper oxide in the bed 132 has been mostly reduced by hydrogen from the offgas, the valves 130 and 136 are actuated to return the system to the first mode. (Prior to switching from one mode to another mode, the passages which had oxygen flowing through them should be flushed briefly with a stream of argon, which is exhausted to the environment, so that no significant nitrogen becomes incorporated into the closed argon circuit.) The first mode configuration directs the offgas to pass through the bed 131 and the desiccant 133. The first bed 131 and desiccant 133 were regenerated while the second bed 132 and desiccant 134 were treating the offgas, and so they can again remove the hydrogen from the offgas. While this occurs, the second bed 132 and desiccant 134 are regenerated by blowing air through them.

The regeneration of the copper into copper oxide should take less time than the reduction of the oxides of copper in the treatment of the offgas stream. This can be achieved by regulating the temperature and air flow rate through the regenerated bed. Furthermore, the capacity of the desiccant should exceed the oxidation and reduction capacity of the bed. This insures that no water vapor will enter the melt.

Because the average hydrogen partial pressure in the rapidly flowing argon-hydrogen gas mix is likely to be only a small fraction of an atmosphere, a much slower air flow rate into the regeneration portion will be adequate to complete the oxidation of the copper prior to the exhaustion of the active copper oxide and desiccant pair.

The temperature regulation of each bed and desiccant pair must be considered. The thermodynamic tendency for reduction of the copper oxide by hydrogen is very high for any temperature from 150 to 500° C., but operation of the system at an excessively high temperature could lead to particle sintering and reduced kinetics. Since the gas coming from the melt is extremely hot, it may be necessary to cool the gas, preferably by heat exchange with the argon entering the gas disperser. Additionally, the reduction of the copper oxide by hydrogen gas is an exothermic reaction since water vapor is formed. When the copper oxide is being reduced, the desiccant should be cooled (or at least not heated) to maintain the temperature range necessary to permit the desiccant to absorb water. On the other hand, when the bed is being oxidized (which is a more highly exothermic reaction), heating of the associated desiccant to desorb the water is probably not necessary.

The oxides of copper (CuO and $Cu_2O$) in supported catalysts are chosen as materials to react with hydrogen because of their low thermodynamic stability (see FIGS. 4 and 5) and their rapid reaction kinetics at temperatures as low as 50° C. The preferred supported copper oxide particles are of the type manufactured by BASF such as catalyst R 3–11.

Figure 4:
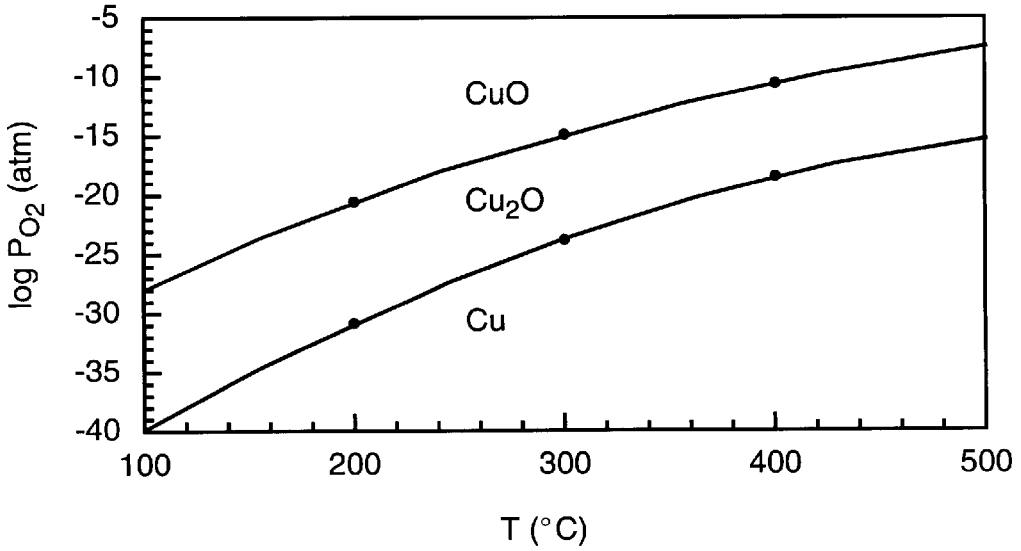
FIGS. 4 & 5 are graphs showing the thermodynamic stability of oxides of copper.
Figure 5:
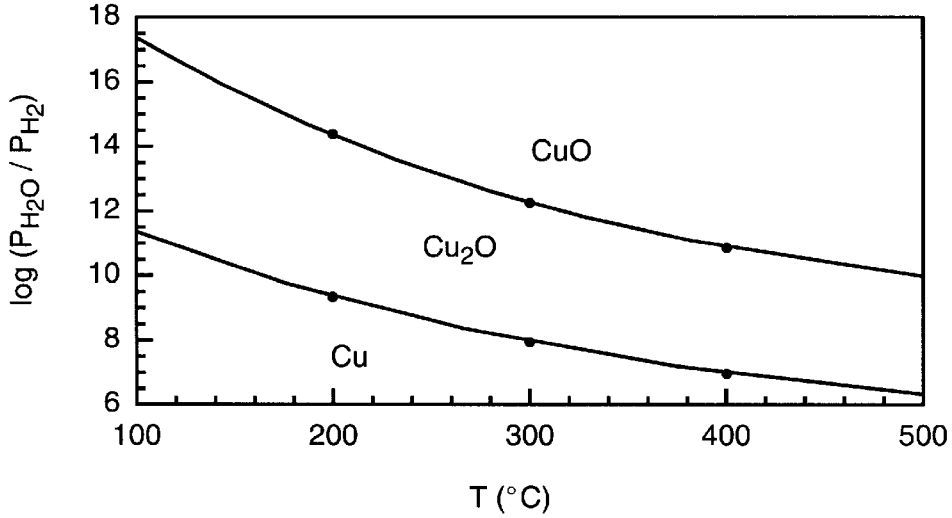
Figure 6:
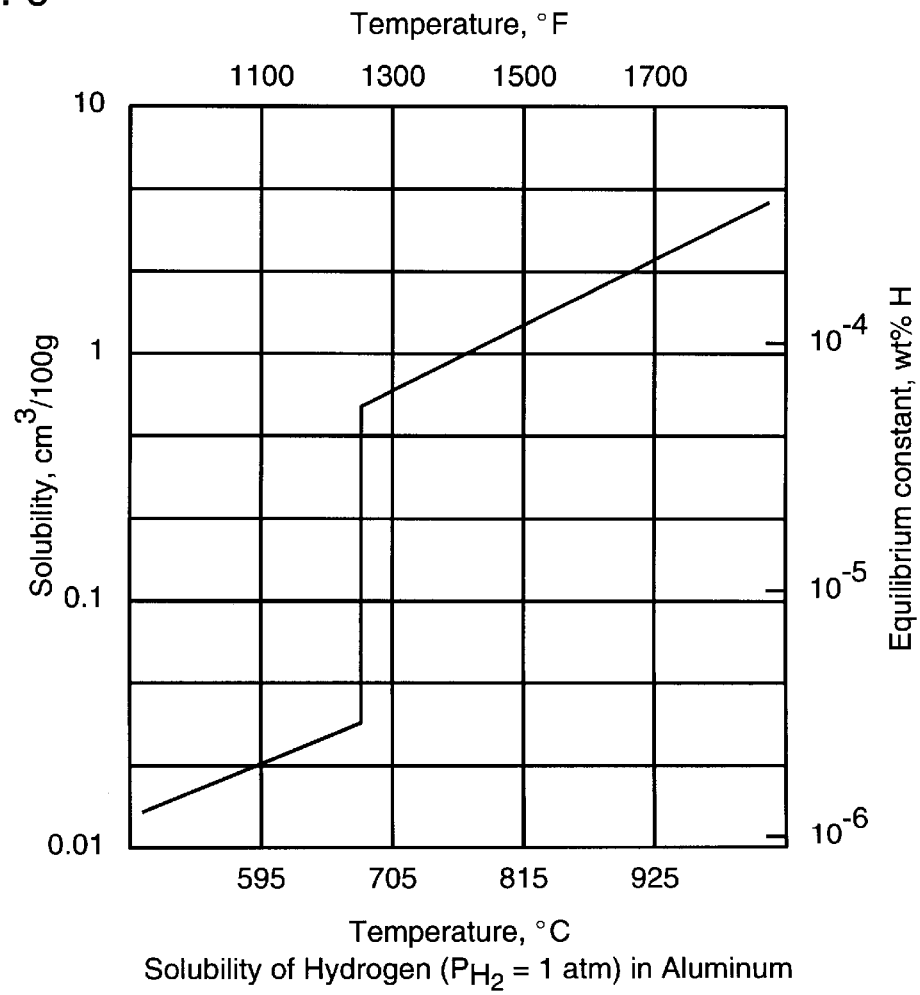
FIG. 6 is a graph showing the solubility of hydrogen in aluminum.

FIGS. 6 and 7 contain equations and FIGS. 4 and 5 contain graphs showing that thermodynamically either CuO or $Cu_2O$ will remove virtually all hydrogen from an argon stream at rather low temperatures. For a fixed bed, however, the degree of completion of the reduction reaction may depend jointly upon the gas flow rate and the bed temperature, and possibly upon other parameters.

Figure 9:
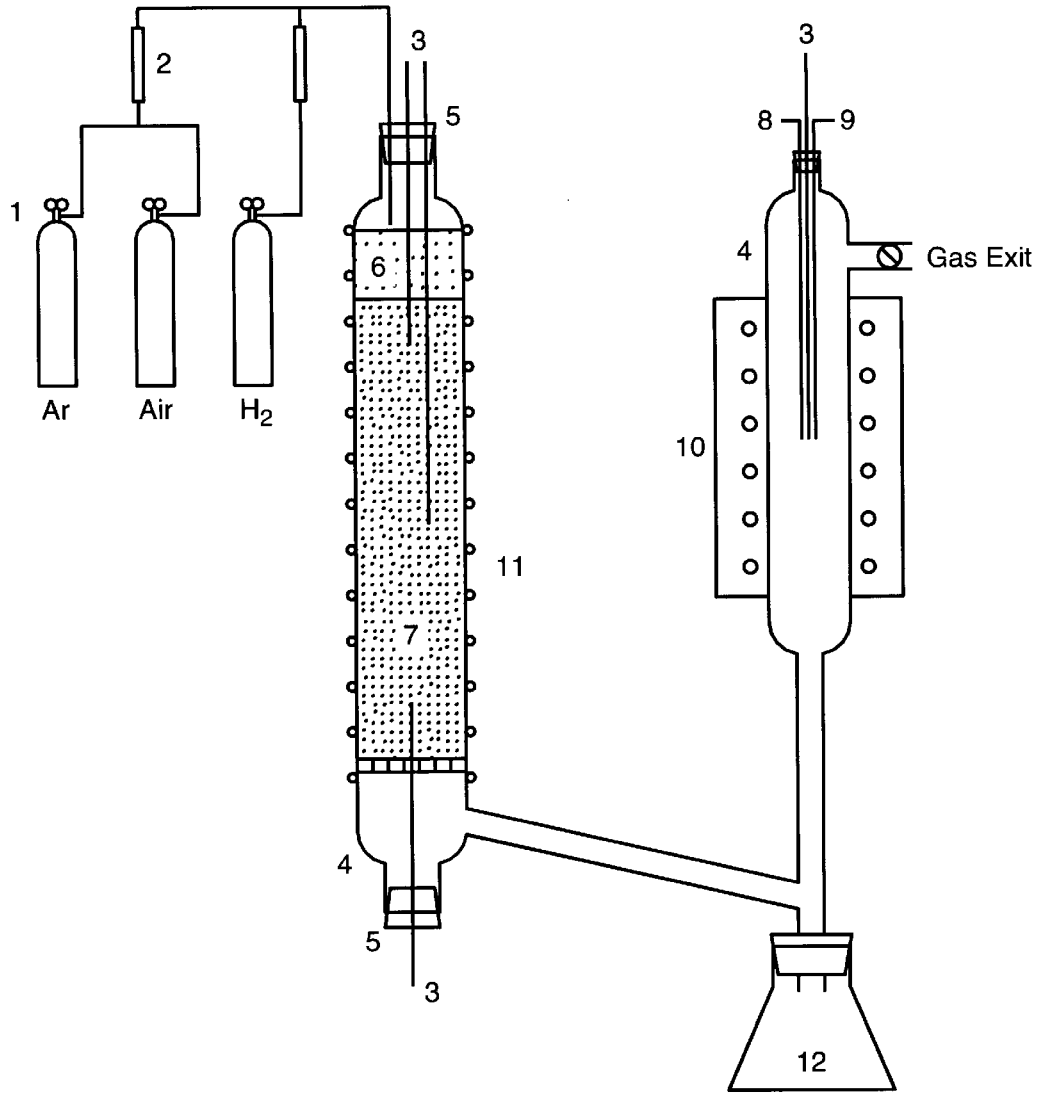
FIG. 9 is a front view illustrating an experimental apparatus.
Figure 10:
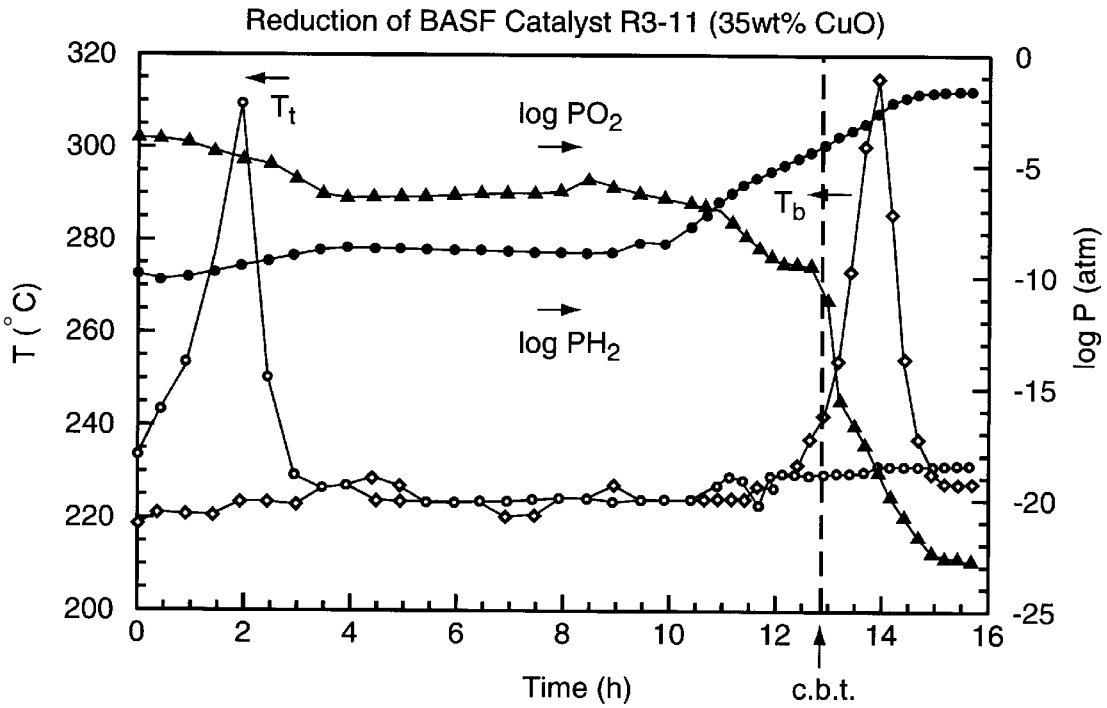
FIG. 10 is a graph showing the partial pressures of hydrogen and oxygen relative to time during reduction of a copper oxide column.
Figure 11:
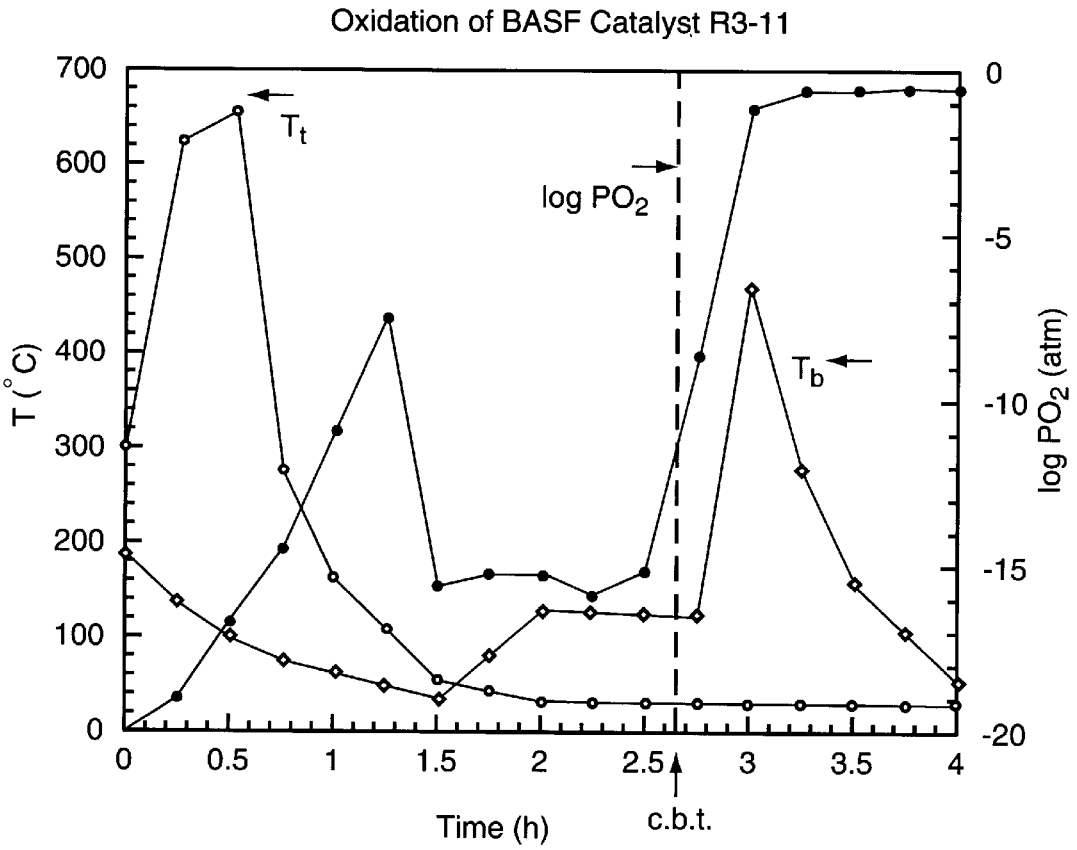
FIG. 11 is a graph showing the partial pressure of oxygen leaving the column relative to time during the oxidation of a copper column.

Referring to FIGS. 9, 10 and 11, experimental results on the argon treatment were obtained. A gas mixture of 5% hydrogen in argon flowed through a bed of BASF catalyst R 3–11. This catalyst bed was about 5 cm internal diameter and 1 m high, and about 2 kg of the catalyst was contained in the fixed bed. The supported catalyst contains 35 wt % cupric oxide. For a given flow rate of 5% hydrogen gas in argon through the cupric oxide bed, the time required for the hydrogen to totally reduce this column 4 in plug flow can be calculated. That assumes that local equilibrium is maintained at the reaction front where cupric oxide is being reduced to copper. The experimental apparatus is drawn in FIG. 9. The oxygen sensor 8 and the hydrogen sensor 9 are solid state sensors held at a temperature of 700° C. The catalyst is contained in the PYREX tube 4, which is being heated by a heating tape 11.

The experimental results are shown in FIG. 10. The starting state for the BASF catalyst R 3–11 was 35% cupric oxide, that is, all of the copper in the column was fully oxidized, and a gas of about 5% hydrogen in argon at about a 3.5 cm per second linear velocity was flowed through the packed bed. The bed was preheated to 225° C. and as the data in the plot indicate, the log $PH_2$ for the gas exiting the column stayed between about $10^{-8}$ and $10^{-10}$ atm, which means that essentially no hydrogen is escaping from the catalyst bed to the sensor 9 shown in FIG. 9. At about 13 hours, the hydrogen pressure, read by the sensor 9, gradually rose to indicate 5% hydrogen, meaning that the cupric oxide in the column had been exhausted, or fully reduced.

These results are entirely consistent with the readings from the oxygen sensor 8 which showed that the oxygen pressure was about $10^{-7}$ atm until the hydrogen excess began to be significant and then the oxygen sensor 8 reading dropped sharply to $10^{-23}$ atm. These represent a double indication that the reduction occurred with virtually plug flow, because the observed breakthrough time is in good agreement with the calculated breakthrough time (c.b.t.) of about 13 hours.

Once the column had been totally reduced with hydrogen, it was re-oxidized, which is the other part of the two-mode regeneration discussed in the argon degassing process. The same column 4 which was initially reduced to copper by hydrogen was subjected to incoming air at a 2 cm per second linear velocity and in that case the calculated breakthrough time (c.b.t.) was 2.65 hours. FIG. 11 shows the results of this experiment. A significant heating is associated with the passage of the reaction front past the two thermocouples, past the thermocouple $T_t$ at the top of the bed and $T_b$ at the bottom of the bed. Nevertheless, although the column was overheated, its oxidation from copper to cupric oxide was complete after about 2.6 or 2.7 hours as indicated by the oxygen plot (shown by the solid circles in FIG. 11). This is in good agreement with the calculated breakthrough time of about 2.6 hours, assuming plug flow reacting the copper to the cupric oxide.

So, in future usage, the solid copper does not have to be heated so high in order to achieve this complete reaction and that will avoid the overheating which occurred. These experimental results show that the sort of compositions and flow rates that one might be interested in for degassing a liquid metal were readily studied and treated in the laboratory by these methods. The results indicated that the inert gas (Ar) can be effectively cleaned of hydrogen by the reduction of copper oxide, and that the resultant copper is readily oxidized by air at low temperature.

Figure 2:
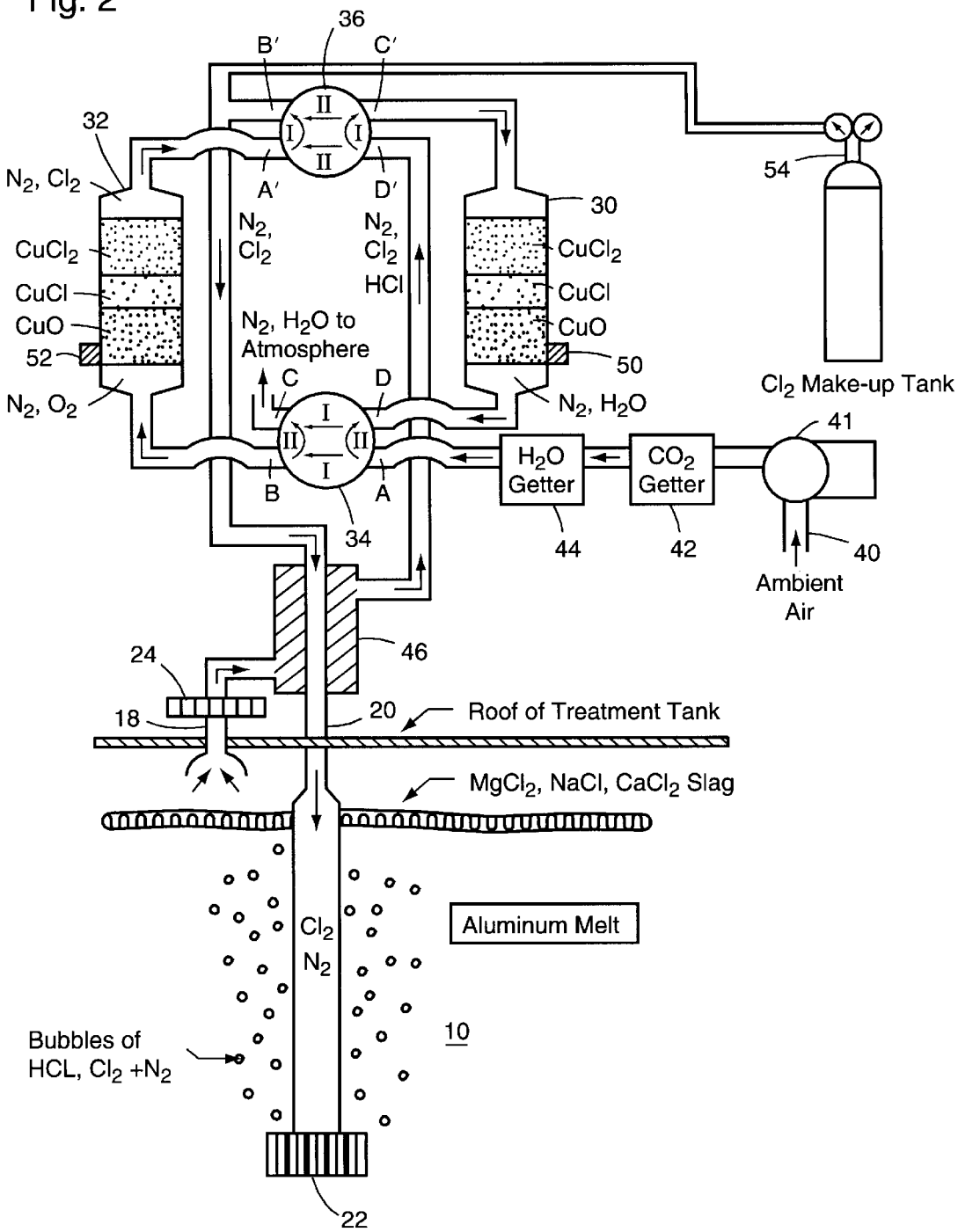
FIG. 2 is a schematic front view illustrating another embodiment of the present invention.

An alternative embodiment of the present invention is shown in FIG. 2 in which an aluminum melt 10 has an inlet tube 20 and a gas disperser 22 (similar to that shown in FIG. 1) submerged partially in it and an outlet 18 in the holding tank roof.

The gas which is directed into the melt 10 is a mixture of $N_2$ and $Cl_2$ which bubbles up through the melt, forming an offgas stream which exits through the outlet 18 in the roof. The carrier gas directed into the melt with the $Cl_2$ can be any inert gas, and is preferably nitrogen. The offgas stream consists of $N_2$, excess $Cl_2$, HCl and aluminum chloride vapor. A particulate filter 24 removes particles from the offgas stream.

The offgas stream exits the treatment vessel 12 and enters a closed loop system which traps and recycles the chlorine and exhausts harmless $N_2$ and water vapor to the atmosphere. The closed loop system includes a first bed 30 and a second bed 32. The beds 30 and 32 can be fixed beds with independently controlled temperatures. Also included are a pair of valves 34 and 36 which determine the path of the gas flowing through connecting pipes, depending upon how the valves 34 and 36 are positioned. The valves 34 and 36 are used to change the recycling system between a first mode in which offgas flows in one direction through the beds, and a second mode in which the gas flows in the opposite direction through the beds.

The theory is that during the first mode of operation, air taken in from the ambient exchanges oxygen for chlorine in the first bed and the chlorine and nitrogen mixture is blown into the melt. The offgas stream of nitrogen, hydrogen chloride and chlorine goes into, and gives up Cl to, the second bed, releasing water vapor and nitrogen to the environment. In the second mode, the gas flow through the beds is reversed, and the bed which earlier gave up chlorine now absorbs it and the bed which earlier absorbed chlorine now releases it. This relationship continues to alternate during the process in response to in-line sensors which indicate the extent of reaction for the beds. However, it has been determined experimentally that this theory does not work as well as predicted for the metal chlorides ($CuCl_2$) used under the conditions ordinarily encountered. Other metal chlorides, such as $MgCl_2$ may work under the desired conditions.

The apparatus of FIG. 1 operates in theory as follows. At the beginning of a degassing cycle, the bed 32 is made of substantially copper (cupric) chloride ($CuCl_2$). Air is pumped by a compressor 41 from the air inlet 40 through a $CO_2$ getter 42 and a water getter 44 into a heat exchanger 46. The compressor 42 should supply air at a rate which gives the desired flow rate of $N_2$ and $Cl_2$ to the bubble disperser 22. A heat exchanger 46 preheats the air with the heat of the offgas coming from the treatment vessel 12. The valve 34 is oriented, in the first mode, to connect the conduit A to the conduit B, which permits air pumped into the system to pass through the bed 32. The air, which is preferably ambient air consisting of oxygen and nitrogen, oxidizes the copper chloride, forming oxides of copper in the bed 32, and releasing $Cl_2$. This follows the reaction $$2CuCl+O_2(g)=2CuO+Cl_2(g). \qquad \text{REACTION 3}$$

An appropriate flow rate can result in a gas mixture of approximately 79% $N_2$ and 21% $Cl_2$. The nitrogen and $Cl_2$ gas mixture is conveyed by the valve 36 from the conduit A' to the conduit B', and then downwardly into the treatment vessel through the gas disperser 22. Principally, the $Cl_2$ reacts with alkali metals and alkaline earth metal impurities in the melt to flux out these solutes. The $Cl_2$ also reacts with hydrogen in the melt and forms gas bubbles comprising HCl, which along with excess $Cl_2$ and $N_2$ gas, flows upwardly to the upper surface of the melt and is released into the outlet 18 as an offgas stream. Some hydrogen dissolved in the aluminum is thus taken out of the melt and incorporated into the offgas stream as HCl.

The offgas stream passes through the particulate filter 24 and upwardly toward the valve 36. The valve 36, in its first mode, connects the conduit D' to the conduit C' which directs the offgas stream into the bed 30. The bed 30 is made substantially of the oxides of copper: CuO and $Cu_2O$. At temperatures below 400° C., the oxides are marginally stable and react with the HCl to transform the oxide solids into CuCl, which remains in the bed 30. This follows the reactions $$CuO+2HCl(g)=CuCl_2+H_2O(g) \qquad \text{REACTION 4}$$

and $$Cu_2O+2HCl(g)=2CuCl+H_2O(g). \qquad \text{REACTION 5}$$

Figure 3:
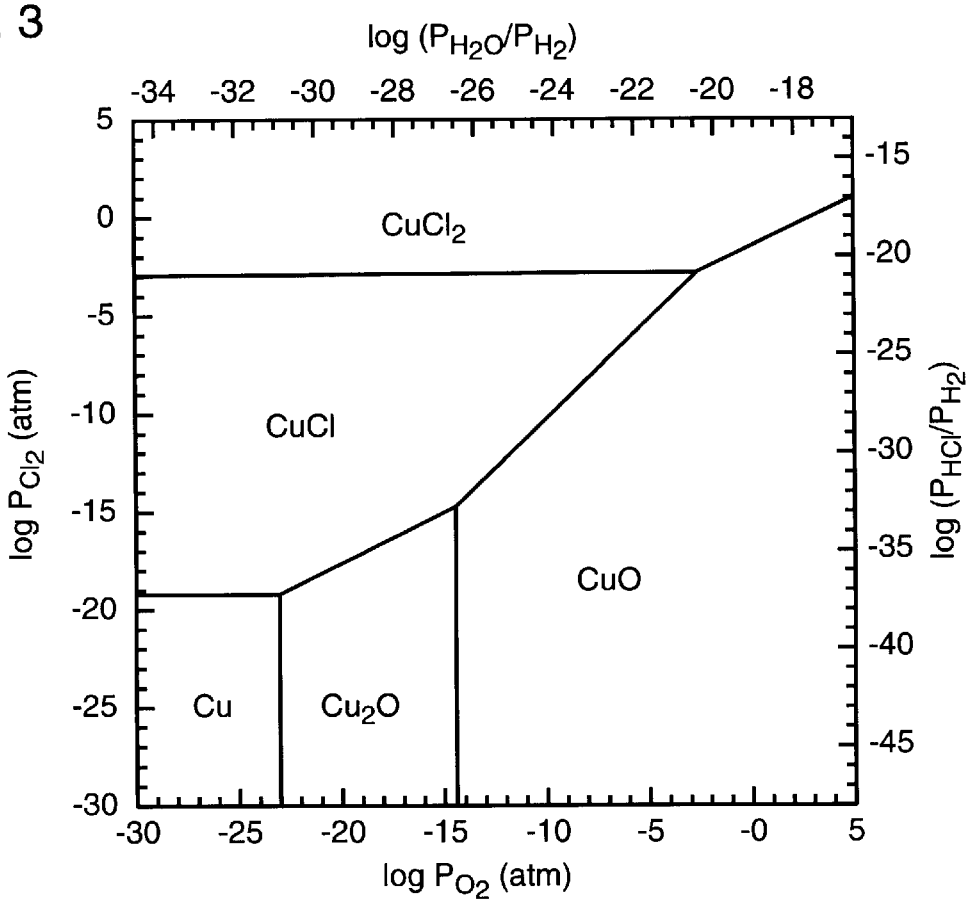
FIG. 3 is a phase stability diagram for the $Cu—O_2—Cl_2$ system.

Upon reacting with the HCl, CuCl is favored over $CuCl_2$, because the chlorine activity of HCl is too low to form $CuCl_2$ (see FIG. 3). The gas phase of the reaction products, $N_2$ and water vapor, is vented to the atmosphere after passing through the valve 34 which, in the first mode, connects the conduit D to the conduit C.

A chlorine sensor 50 or else a thermocouple at the outlet side of the bed 30 signals actuators for the valves 34 and 36 to switch from the first mode to a second mode, thereby reversing the flow of gas through the beds 30 and 32. When some sufficient predetermined amount of chlorine begins to pass through the bed 30, the valves 34 and 36 are actuated into the second mode to connect the conduits A–D and A'–D' in materially different flow paths.

When the systems enter the second mode (in which the gas flow through the beds 30 and 32 is reversed), air entering through the inlet 40 is directed from the conduit A to the conduit D at the valve 34. This air passes through the bed 30, which is made of substantially CuCl due to its earlier reaction with the offgas stream. The oxygen in the air oxidizes the CuCl according to REACTION 3, forming oxides of copper within the bed 30 and releasing a mixture of $N_2$ and $Cl_2$ into the conduit C'. The valve 36, in the second mode, connects the conduit C' with the conduit B' to permit the $N_2$ and $Cl_2$ gas to flow into the treatment tank 12. For the process parameters of the system, such as temperature, gas flow rate, etc., CuO formation is dominant during regeneration.

The offgas stream exiting the treatment tank 12 through the outlet 18 flows through the conduit D' to the valve 36. In the second mode, the valve 36 connects the conduit D' to the conduit A', directing the offgas stream to the bed 32. The bed 32 contains oxides of copper which react with the offgas stream of $N_2$, $Cl_2$ and HCl transforming the gas into nitrogen and water vapor as shown in REACTIONS 4 and 5. Any excess $Cl_2$ tends to react in the bed to form copper chloride. The gas is exhausted into the environment through the conduit B and the valve 34 which connects the conduit B to the conduit C. The oxides of copper are transformed into copper chloride. A chlorine sensor 52 in the bed 32 signals conventional actuators (not shown) connected to the valves 34 and 36 to actuate them once a predetermined amount of $Cl_2$ has passed through the bed 32. This actuation returns the system to the first mode, in which the first bed 30 stores chlorine from the offgas stream and the second bed 32 releases stored chlorine as the solids are transformed back into oxides of copper.

In this cyclical treatment system, the offgas stream is treated to remove chlorine by storing it in solid form in a bed as $CuCl_2$. By such treating of the offgas, only harmless nitrogen and water are released to the atmosphere. Upon saturation of the first bed with chlorine, the second bed of CuO is used to store chlorine from the offgas while the first copper bed gives up its chlorine, and the chlorine is recycled back into the melt. By cycling the reaction functions back and forth between the beds, a negligible amount of chlorine is released to the atmosphere, while at the same time minimizing the amount of chlorine which must be purchased and handled to treat the aluminum melt. Since some chlorine will be consumed in the formation of sodium chloride, calcium chloride, etc. slags, a small amount of chlorine will be added to the system as necessary by a make-up cylinder or container 54.

The conversion of $CuCl_2$ to CuO by oxygen is an exothermic process, and the temperature of the regeneration process must be controlled to set some adequate reaction rate. The cool input ambient air can be preheated to a desired temperature by the heat exchanger shown in FIGS. 1 and 2. By this heat exchange, the oxidation of the chloride can also be maintained at an optimum temperature.

To insure that negligible chlorine emissions occur, an excess of copper oxide in the system is preferable. Therefore, when all of the chlorine available in the bed which is being oxidized is expended, some amount of copper oxide will remain in the bed which is collecting chlorine. Chlorine can be sensed by solid state chlorine sensors which can monitor the chlorine partial pressure at various points in the gas streams for the purpose of adding it when needed, while verifying the absence of chlorine escaping into the environment.

Chlorine gas may cause the metallic parts of the system to corrode. However, if the parts susceptible to corrosion are held below about 400° C., and if water vapor or oxygen do not co-exist with the chlorine, then significant corrosion can be avoided if alloys high in nickel are chosen for the system parts.

FIG. 8 assumes that local equilibrium is achieved for a nitrogen stream containing chlorine ($Cl_2$) and illustrates that the high thermodynamic stability of HCl gas insures that some of the chlorine introduced into the melt at a reasonable rate is converted into HCl gas.

Virtually no chlorine will escape to the environment because chlorine is always restricted to the central volume of the gas train, either as $Cl_2$, HCl or else as solid copper chloride. CuO is always present at both the entrance and the exit of the total gas train to the environment, and $Cl_2$ cannot bypass the CuO without reaction to form CuCl. In this regard, the closed "internal chlorine" system may find some further general application for other processing reactions unrelated to aluminum.

The embodiments shown in FIG. 1 and FIG. 2 can be combined under certain circumstances. The inventor has performed experiments which bring the effectiveness of copper chloride into question. But there is some evidence that other metal salts, such as manganese chloride, will be more effective, due to a better balance between the stabilities of the metal oxide and the metal chloride under the conditions in which the method is practiced.

While certain preferred embodiments of the present invention have been disclosed in detail, it is to be understood that various modifications may be adopted without departing from the spirit of the invention or scope of the following claims.

I claim:

1. A method of reclaiming an inert carrier gas which removes hydrogen from a liquid metal, comprising the steps of:

(a) injecting the carrier gas into the liquid metal to form a first offgas stream containing a mixture of substantially hydrogen and carrier gas;

(b) contacting a first bed of copper oxide with the first offgas stream to form copper in the first bed and a second offgas stream containing a mixture of substantially water vapor and carrier gas; and (c) removing the water vapor from the second offgas stream to form a third offgas stream containing substantially carrier gas;

(d) injecting the third offgas stream into the liquid metal;

(e) selectively switching the first offgas stream from a first mode in which the first offgas stream contacts the first bed of copper oxide to a second mode in which the first offgas stream contacts a second bed of copper oxide to form copper in the second bed and a fourth offgas stream containing a mixture of substantially water vapor and carrier gas;

(f) removing the water vapor from the fourth offgas stream to form a fifth offgas stream containing substantially carrier gas;

(g) injecting the fifth offgas stream into the liquid metal;

(h) regenerating the first bed to convert copper in the first bed to copper oxide while the first offgas is contacting the second bed of copper oxide; and (i) selectively switching the first offgas stream between the first and second modes.

2. A method in accordance with claim 1, wherein selectively switching comprises actuating at least one gas valve to divert the first, third and fifth offgas streams.

3. A method in accordance with claim 2, wherein a first sensor is mounted to the first bed and a second sensor is mounted to the second bed, and the method further comprises transmitting a signal from at least one of the sensors to a valve actuator for actuating the at least one gas valve.

4. A method in accordance with claim 1, wherein regenerating the first bed comprises contacting the first bed with a stream of air.

5. A method in accordance with claim 1, further comprising flushing a gas passageway with carrier gas before injecting the fifth offgas stream into the liquid metal.

6. A method in accordance with claim 1, wherein the carrier gas is argon.

7. A method of reclaiming an inert carrier gas which removes hydrogen from a liquid metal, comprising the steps of:

(a) injecting the carrier gas into the liquid metal, to form a first offgas stream containing a mixture of substantially hydrogen and carrier gas;

(b) contacting a first bed of copper oxide with the first offgas stream to form copper in the first bed and a second offgas stream containing a mixture of substantially water vapor and carrier gas; and (c) removing the water vapor from the second offgas stream to form a third offgas stream containing substantially carrier gas.

8. A method in accordance with claim 7, further comprising injecting the third offgas stream, containing substantially carrier gas, into the liquid metal.

9. A method in accordance with claim 7, further comprising regenerating the first bed to convert copper in the first bed to copper oxide.

10. A method of reclaiming chlorine which is injected into a liquid metal, for removing hydrogen from the liquid metal, the method comprising:

(a) contacting a first bed containing substantially metal chloride with air, which oxidizes the metal chloride and forms a gas containing chlorine;

(b) injecting the gas containing chlorine into the liquid metal, forming a first offgas stream containing hydrogen and chlorine;

(c) contacting a second bed containing substantially metal oxide with the first offgas stream, wherein the hydrogen in the first offgas stream reacts with the oxygen in the metal oxide and the chlorine in the first offgas stream reacts with the metal in the metal oxide, forming metal chloride in the second bed and a second offgas stream containing water vapor; and (d) exhausting the second offgas stream into the ambient.

11. A method in accordance with claim 10, further comprising:

(a) actuating a valve for reversing the flow of gases once the second bed contains a predetermined amount of metal chloride;

(b) contacting the second bed with air, which oxidizes the metal chloride and forms a gas containing chlorine;

(c) injecting the gas containing chlorine into the liquid metal, forming a first offgas stream containing hydrogen and chlorine;

(d) contacting the first bed, containing substantially metal oxide, with the first offgas stream, wherein the hydrogen in the first offgas stream reacts with the oxygen in the metal oxide and the chlorine in the first offgas stream reacts with the metal in the metal oxide, forming metal chloride in the first bed and a second offgas stream containing water vapor; and (e) exhausting the second offgas stream into the ambient.

* * * * *